US005200301A

United States Patent [19]

Wingender et al.

[11] Patent Number: 5,200,301

[45] Date of Patent: Apr. 6, 1993

[54] COLOR PHOTOGRAPHIC RECORDING MATERIAL

[75] Inventors: Kaspar Wingender, Leverkusen; Wolfgang Schmidt, Bergisch-Gladbach, both of Fed. Rep. of Germany

[73] Assignee: Agfa Gevaert Aktiengesellschaft, Leverkusen, Fed. Rep. of Germany

[21] Appl. No.: 795,118

[22] Filed: Nov. 20, 1991

[30] Foreign Application Priority Data

Dec. 7, 1990 [DE] Fed. Rep. of Germany ..... 4039022

[51] Int. Cl.[5] ..... G03C 1/46; G03C 5/42

[52] U.S. Cl. ..... 430/373; 430/567; 430/364; 430/461; 430/503

[58] Field of Search ..... 430/364, 565, 402, 461, 430/373, 503, 567

[56] References Cited

U.S. PATENT DOCUMENTS 3,819,372 6/1974 Newman et al. ..... 430/364
4,774,168 9/1988 Ogawa et al. ..... 430/567
4,954,425 9/1990 Iwano ..... 430/461

*Primary Examiner*—Charles L. Bowers, Jr.
*Assistant Examiner*—Mark F. Huff
*Attorney, Agent, or Firm*—Connolly and Hutz

[57] ABSTRACT

A color photographic recording material comprising at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler and, optionally, a silver halide emulsion layer with no color coupler, of which the silver halide coatings together, expressed as $AgNO_3$, amount to no more than 0.8 $g/m^2$ and of which the silver halides have a silver chloride component of at least 95 mol-%, characterized in that the silver halide coating of a silver halide emulsion layer containing a color coupler together with the silver halide coating of the silver halide emulsion layer with no color coupler, expressed as $AgNO_3$, is from 0.2 to 0.6 $g/m^2$ and the silver halide coating of all the other silver halide emulsion layers, expressed as $AgNO_3$, amounts to no more than 0.2 $g/m^2$, can be processed in a development/intensification process.

5 Claims, No Drawings

COLOR PHOTOGRAPHIC RECORDING MATERIAL

This invention relates to a color photographic silver halide material which is particularly suitable for the production of colored machine-readable identification systems.

Machine-readable detection systems normally operate by IR absorption of the data applied, photographically produced identifications being read by IR absorption of the image silver.

Where color photography is to be used for the identification system, the problem arises that there is no longer any image silver to absorb IR light as a result of standard photographic processing (development, bleaching, fixing). On the other hand, the dyes formed by coupling of the color couplers with the oxidized developers do not have sufficient IR absorption capacity. Accordingly, efforts have been made to develop color couplers which also absorb IR light.

So far, these efforts have not produced convincing results.

The problem addressed by the present invention was to provide a color photographic material which, on the one hand, would produce a clear, brilliant dye image, but which on the other hand would show adequate IR absorption in the data part, the IR-absorbing zones being photographically produced.

This problem has been solved by a new color photographic material which contains at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler and, optionally, a silver halide emulsion layer with no color coupler, of which the silver coatings, expressed as $AgNO_3$, together amount to no more than 0.8 g/m$^2$ and of which the silver halides have a silver chloride component of at least, 95 mol-%, characterized in that the silver halide coating for one color sensitivity containing at least one color coupler together with the silver halide coating of the silver halide emulsion layer with no color coupler, expressed as $AgNO_3$, is between 0.2 and 0.6 g/m$^2$ and the silver halide coating of all the other silver halide emulsion layers together, expressed as $AgNO_3$, is no more than 0.2 g/m$^2$.

If the material contains a silver halide emulsion layer with no color coupler, the layer in question preferably contains a white coupler, a white coupler being understood to be any compound which reacts with the developer oxidation product to form a colorless product. This layer is preferably red- or pan-sensitized.

In this case the layer, which together with the layer containing no color coupler, amounts to 0.2 to 0.6 g/m$^2$ silver halide in terms of $AgNO_3$, is preferably the at least one red-sensitive layer containing at least one cyan coupler.

The silver halide emulsions preferably have average particle diameters of at least 0.1 μm and, more particularly, from 0.2 to 2.0 μm.

The layer with no color coupler may contain an IR coupler. It has a silver coating, expressed as $AgNO_3$, of in particular from 0.1 to 0.5 g/m$^2$.

In another advantageous embodiment, the silver halide emulsion of the layer with no color coupler has a steeper gradation and greater hiding power than the other emulsions.

The silver halide emulsion layer with no color coupler may be in any position to the silver halide emulsion layers containing color couplers.

If the material does not contain a silver halide emulsion layer with no color coupler, the red-sensitive layer preferably has a silver halide coating, expressed as $AgNO_3$, of 0.2 to 0.6 g/m$^2$.

All the silver halide emulsions are preferably silver chloride bromide emulsions containing 0.1 to 3 mol-% silver bromide or pure AgCl emulsions. At least 50% of the silver bromide is preferably situated at the surface of the silver halide grains. Emulsions such as these are obtained in particular by treatment of AgCl emulsions and AgClBr emulsions having a lower bromide content than desired with an aqueous solution of a bromide after sensitization.

These silver halide emulsions preferably have a bromide content of 0.2 to 2 mol-%.

In addition, the silver halide emulsions may contain up to 0.5 mol-% silver iodide, but are preferably free from silver iodide.

The color photographic recording material preferably consists of a reflective support to which a blue-sensitive layer containing at least one yellow coupler, a green-sensitive layer containing at least one magenta coupler, a pan-sensitive layer with no color coupler and a red-sensitive layer containing at least one cyan coupler and also typical interlayers and protective layers are applied in the order indicated.

The present invention also relates to a process for developing the above-described material, in which the material is treated after exposure with a color developer of the p-phenylenediamine and aqueous $H_2O_2$ or a compound which releases $H_2O_2$ (development and intensification) and is subsequently fixed without bleaching or stabilized.

The developer oxidation product required for the intensification step is produced by decomposition of $H_2O_2$ at the silver developed imagewise. High color densities are formed despite the low silver density.

Development and intensification may be carried out in one or two baths, the concentration of color developer preferably being from 0.01 to 0.1 mol/1 and the concentration of $H_2O_2$ from 0.5 to 25 g/1.

Development, intensification, fixing or stabilization may be followed by the usual steps of rinsing and drying. There is no need for fixing (dissolving of the unexposed silver halide) if the silver halide is converted by a stabilizing bath into a non-photosensitive silver complex salt. In this case, stabilization may be immediately followed by drying.

During exposure to form the image, the data part is preferably exposed to light of greater intensity in relation to the image part which is to produce a dye image, so that an IR-absorbing silver image is formed there.

In addition to the silver halide grains and the color couplers, the silver halide emulsion layers essentially contain a binder which is also the principal constituent of the interlayers and protective layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halides used in accordance with the invention may consist of predominantly compact crystals which may have, for example, a regular cubic or octahedral form or transitional forms. The silver halides may also be present as platelet-like crystals of which the average diameter-to-thickness ratio is, for example, at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example from 12:1 to 30:1.

The average grain size of the emulsions is preferably between 0.2 μm and 2.0 μm; the grain size distribution may be both homodisperse and heterodisperse. A homodisperse grain size distribution means that 95% of the grains differ from the average grain size by no more than ± 30%. Homodisperse silver halide emulsions are preferred. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al., Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which no nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq. and Research Disclosure no. 17643 (Dec. 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type area, azaindenes, preferably tetra- and pentaazaindenes, especially those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are also suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure no. 17643 (Dec. 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfuric or phosphoric acid esters of an aminoalcohol. Other suitable synthetic surfactants are fluorine-containing surfactants which are known, for example, from GB-PS 1,330,356, 1,524,631 and U.S. Pat. Nos. 3,666,478 and 3,689,906.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (Dec. 1978), Chapter IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathiaor selenocarbocyanines and 9-ethyl naphthothiaoxa- and benzimidazocarbocyanines, providing the dye contains at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group;

4. as pan sensitizers 9-methylcarbocyanines with benzthiazole, benzselenoazole or naphthothiazole as basic terminal groups which may be substituted in the 5- and/or 6-position by halogen, methyl, methoxy, carbalkoxy or aryl.

Color couplers for producing the cyan component dye image are generally couplers of the phenol or α-naphthol type. Color couplers for producing the magenta component dye image are generally couplers of the 5-pyrazolone type, the indazolone type or the pyrazoloazole type. Color couplers for producing the yellow component dye image are generally couplers containing an open-chain ketomethylene group, more especially couplers of the benzoyl acetanilide and α-pivaloyl acetanilide type. Numerous examples of the couplers are described in the literature. The coupler may also be high molecular weight couplers, so-called latex couplers.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921 EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (Dec. 1978), Chapter VII, 17 842 (Feb. 1979) and 18 716 (Nov. 1979) page 650 and in EP-A-0 069 070, 0 098 072, 0 124 877, 0 125 522.

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended to protect image dyes against fading under the effect of UV-rich daylight. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71, cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Particularly suitable UV absorbers should absorb light up to 400 nm and should fall steeply in their light absorptivity at wavelengths above 400 nm.

The following are examples of particularly suitable compounds:

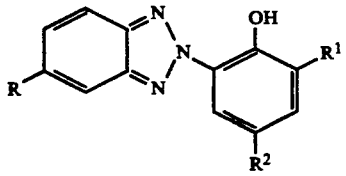

$R, R^1 = H; R^2 = -C_4H_9-t$
$R = H; R^1, R^2 = -C_4H_9-t$
$R = H; R^1, R^2 = -C_5H_{11}-t$
$R = H; R^1 = -C_4H_9-s; R^2 = -C_4H_9-t$
$R = Cl; R^1 = -C_4H_9-t; R^2 = -C_4H_9-s$
$R = Cl; R^1, R^2 = -C_4H_9-t$
$R = Cl; R^1 = -C_4H_9-t; R^2 = -CH_2-CH_2-COOC_8H_{17}$
$R = H; R = -C_{12}H_{25}-i; R^2 = -CH_3$
$R^1, R^2 = -C_4H_9-t$

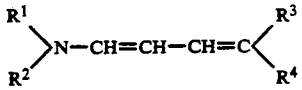

$R^1, R^2 = -C_6H_{13}-n; R^3, R^4 = -CN$
$R^1, R^2 = -C_2H_5; R^3 =$

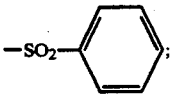

$R^4 = -CO-OC_8H_{17}$
$R^1, R^2 = -C_2H_5; R^3 =$

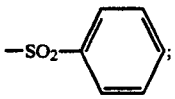

$R_4 = -COO-C_{12}H_{25}$
$R^1, R^2 = -CH_2=CH-CH_2; R^3, R^4 = -CN$

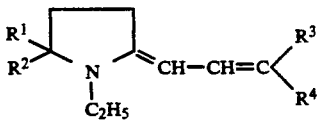

$R^1, R^2 = H; R^3 = -CN; R^4 = -CO-NHC_{12}H_{25}$
$R^1, R^2 = -CH_3; R^3 = CN; R^4 = -CO-NHC_{12}H_{25}$

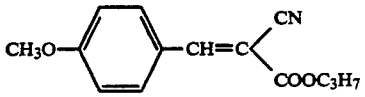

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (Dec. 1978), Chapter V, in U.S. Pat. Nos. 2,632,701 and 3,269,840 and in GB-A-852,075 and 1,319,763.

Certain binder layers, particularly the layer furthest from the support, but occasionally interlayers as well, particularly where they are the layer furthest from the support during production, may contain inorganic or organic, photographically inert particles, for example as matting agents or as spacers (DE-A-33 31 542, DE-A-34 24 893, Research Disclosure 17 643, Dec. 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment of magenta-red dye images, particularly their impairment as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A974,723 and GB-A-1,167,207), divinylsulfone compounds, 5-acetyl-1,3-diacryloyl hexahydro-1,3,5-triazine and other compounds containing a reactive olefin bond (U.S. Pat. No. 3,635,718, U.S. Pat. No. 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-O 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

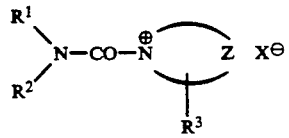

in which $R^1$ is alkyl, aryl or aralkyl, $R^2$ has the same meaning as $R^1$ or represents alkylene, arylene, aralkylene or alkaralkylene, the second bond being attached to a group corresponding to the formula

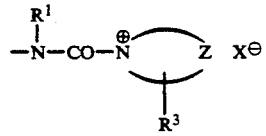

or $R^1$ and $R^2$ together represent the atoms required to complete an optionally substituted heterocyclic ring, for example a piperidine, piperazine or morpholine ring, the ring optionally being substituted, for example, by $C_{1-3}$ alkyl or halogen, $R^3$ is hydrogen, alkyl, aryl alkoxy, $-NR^4-COR^5-$, $-(CH_2)_m-NR^8R^9$, $-(CH_2)_n13\ CONR^{13}R^{14}$ or $$-(CH_2)_p-\underset{\underset{R^{15}}{|}}{CH}-Y-R^{16}$$

or is a bridge member or a direct bond to a polymer chain, $R^4$, $R^6$, $R^7$, $R^9$, $R^{14}$, $R^{15}$, $R^{17}$, $R^{18}$ and $R^{19}$ being hydrogen or $C_1$–$C_4$ alkyl, $R^5$ being hydrogen, $C_{1-4}$ alkyl or $NR^6R^7$, $R^8$ being $-COR^{10}$, $R^{10}$ being $NR^{11}R^{12}$, $R^{11}$ being $C_{1-4}$ alkyl or aryl, particularly phenyl, $R^{12}$ being hydrogen, $C_{1-4}$ alkyl or aryl, particularly phenyl, $R^{13}$ being hydrogen, $C_{1-4}$ alkyl or aryl, particularly phenyl, $R^{16}$ being hydrogen, $C_{1-4}$ alkyl, $COR^{18}$ or $CONHR^{19}$, m being a number of 1 to 3, n being a number of 0 to 3, p being a number of 2 to 3 and Y being 0 or $NR^{17}$ or $R^{13}$ and $R^{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

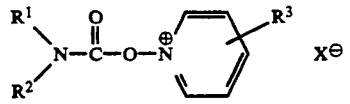

in which $=R^1$, $R^2$, $R^3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfon-amidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

The treatment with aqueous $H_2O_2$ may be carried out at the same time as or after development.

The fixing bath is generally followed by rinsing which is carried out as countercurrent rinsing.

Favorable results can be obtained where a final bath containing little or no formaldehyde is subsequently used.

However, rinsing may be completely replaced by a stabilizing bath which is normally operated in countercurrent. Where formaldehyde is added, this stabilizing bath also serves as a final bath.

The process according to the invention using the material according to the invention gives a significant silver image only in the high-density parts of the color-coupling layers, although it is not troublesome in those parts; elsewhere a clear dye image is obtained. The silver image of the color coupling layers supported by the silver image of the added emulsion gives a sufficiently IR-readable image in the data part of the identification system. The steeper gradation and the greater hiding power of the added emulsion have a particularly positive effect in this regard.

PREPARATION OF THE EMULSIONS

EMULSION 1

A monodisperse silver chloride emulsion having an average grain diameter of 0.8 μm was prepared by double-jet inflow of an $AgNO_3$ solution and an NaCl solution containing $Na_4IrCl_6$. The Ir content was $0.05 \times 10^{-6}$ mol/mol Ag. The emulsion was flocculated, washed and redispersed with gelatine in the usual way. The ratio by weight of gelatine to silver (as $AgNO_3$) was 0.5. The AgCl content was 1 mol per kg emulsion.

The emulsion was then ripened to optimal sensitivity, sensitized for the blue spectral region and stabilized.

0.5 Mol-%, based on total silver, of a KBr solution in the form of an aqueous solution was added to this starting emulsion (EM 1).

EMULSION 2

A green-sensitive emulsion containing 99.5 mol-% chloride and 0.5 mol-% bromide and having an average grain diameter of 0.4 μm was prepared in the same way as EM 1 (EM 2).

EMULSION 3

A red-sensitive emulsion containing 99.5 mol-% chloride and 0.5 mol-% bromide and having a grain diameter of 0.35 μm was prepared in the same way as EM 1 (EM 3).

EMULSION 4

A solution of 15 g inert bone gelatine in 500 ml water is adjusted to pH 3.5 with sulfuric acid and kept at a constant temperature of 40° C. Using the double jet process, a solution of 170 g silver nitrate in 300 ml water and a solution of 62 g sodium chloride in 400 ml water are simultaneously added with vigorous stirring over a period of 30 minutes during which the pAg value is kept at 7.1.

The emulsion obtained is freed from soluble salts by flocculation and is redispersed with addition of another 104 g inert bone gelatine. 1 kg of an AgCl emulsion having an average grain size of 0.15 μm is obtained. The emulsion is chemically ripened with 5 μmol sodium thiosulfate and 10 μmol potassium tetrachloroaurate per mol AgCl for 150 minutes at a temperature of 55° C.

The emulsion was red-sensitized in the same way as EM 3 (EM 4).

EMULSION 5

A pan-sensitized emulsion is prepared in the same way as EM 4 (EM 5).

EXAMPLE 1 (COMPARISON)

A color photographic recording material was prepared by application of the following layers in the order indicated to a layer support of paper coated on both sides and polyethylene. The quantities shown are all based on 1 $m^2$. For the silver halide coating, the corresponding quantities of $AgNO_3$ are shown.

1st layer (substrate layer):

0.3 g gelatine

2nd layer (blue-sensitive layer)

0.08 g $AgNO_3$ EM 1

1.0 g gelatine
0.6 g yellow coupler GB 1
0 48 g tricresyl phosphate
3rd layer (protective layer):
1.1 g gelatine
0.06 g 2,5-dioctyl hydroquinone
0.06 g dibutyl phthalate
4th layer (green-sensitive layer):
0.05 g $AgNO_3$ EM 2
1.08 g gelatine
0.4 g magenta coupler PP 1
0.43 g tricresyl phosphate
5th layer (UV protective layer):
1.3 g gelatine
0.56 g UV absorber UV 1
0.3 g tricresyl phosphate
6th layer (red-sensitive layer)
05 g $AgNO_3$ EM 3
0.70 g gelatine
0.38 g cyan coupler BG 1
0.38 g tricresyl phosphate
7th layer (UV protective layer)

0.60 g gelatine
0.2 g UV absorber UV 1
0.1 g tricresyl phosphate
8th layer (hardener layer)
0.9 g gelatine
0.2 g hardener H 1

EXAMPLE 2

1st to 4th layers as in Example 1
5th layer (protective layer)
2.0 g gelatine
0.85 g UV absorber UV 1
0.3 g dioctyl hydroquinone
0.73 g tricreyl phosphate
6th layer (red-sensitive IR-absorbing layer)
0.3 g $AgNO_3$ EM 4
0.1 g gelatine
0.38 g dioctyl hydroquinone
0.38 g tricresyl phosphate
7th layer (protective layer)
0.15 g gelatine
0.3 g 2,5-dioctyl hydroquinone
3 g tricresyl phosphate
8th layer as 6th layer of Example 1
9th layer as 7th layer of Example 1
10th layer as 8th layer of Example 1

EXAMPLE 3

A layer material was prepared in the same way as described in Example 2, except that emulsion EM 4 in layer 6 was replaced by the pan-sensitive emulsion EM 5.

EXAMPLE 4

1st to 4th layers as in Example 2
5th layer (protective layer)
1.3 g gelatine
0.56 g UV absorber UV 1
0.06 g 2,5-dioctyl hydroquinone
0.35 g tricresyl phosphate
6th layer (IR absorption layer)
0.3 g $AgNO_3$ EM 4
0.1 g gelatine
0.38 g white coupler WK 1
0.38 g tricresyl phosphate
7th layer (protective layer)
0.15 g gelatine
0.1 g 2,5-dioctyl hydroquinone
0.1 g tricresyl phosphate
8th to 10th layers as in Example 2

EXAMPLE 5

1st to 6th layers as in Example 2
7th layer (protective layer)
none
8th to 10th layers as in Example 2

The layer materials of Examples 1 to 5 thus produced were exposed through a step wedge in a sensitometer (light intensity 120 Lx · s) and developed as follows:

| | | |
|---|---|---|
| Color development | 35° C. | 20 secs. |
| Intensification | 23° C. | 10 secs. |
| Fixing | 23° C. | 20 secs. |
| Rinsing | 23° C. | 60 secs. |
| Color developer solution | | |
| Polyglycol P 400 | | 22 ml |
| Diethyl hydroxylamine (85% by weight) | | 6 ml |
| CD3 | | 10 g |
| Potassium sulfite | | 0.33 g |
| 1-Hydroxyethane-1,1-diphosphonic acid | | 0.14 g |
| Potassium hydrogen carbonate | | 5 g |
| Potassium carbonate | | 22 g |
| Potassium hydroxide | | 8 g |
| Dodecyl benzenesulfonate | | 0.02 g |
| Methyl benzotriazole | | 0.005 g |
| Make up with water to 1,000 ml; | | pH 10.6 |
| Intensification bath | | |

Aqueous hydrogen peroxide, 0.5% by weight, adjust with KOH to pH 7.0

| | |
|---|---|
| Fixing solution | |
| Ammonium thiosulfate | 50 g |
| Sodium sulfite | 5 g |
| Sodium hydrogen sulfite | 2 g |
| Make up with water to 1,000 ml; | pH 6.0 |

EXAMPLE 6

A layer material was produced in the same way as in Example 2, except that 0.4 mg/m$^2$ 5-butyl benztriazole was added to the blue-sensitive emulsion, exposed in a sensitometer as in Examples 1 to 5 and processed as follows:

| | | |
|---|---|---|
| Developer intensifier bath | 35° C. | 20 secs. |
| Fixing bath | 23° C. | 20 secs. |
| Rinsing | 23° C. | 60 secs. |
| Developer intensifier solution | | |
| Polyglycol P 400 | | 22 ml |
| Diethyl hydroxylamine (85% by weight) | | 6 ml |
| CD3 | | 10 g |
| Potassium sulfite | | 0.33 g |
| 1-Hydroxyethane-1,1-diphosphonic acid | | 0.14 g |
| Potassium hydrogen carbonate | | 5 g |
| Potassium carbonate | | 22 g |
| Potassium hydroxide | | 8 g |
| Dodecyl benzensulfonate | | 0.02 g |
| Hydrogen peroxide, 35% by weight | | 10 ml |
| Make up with water to 1,000 ml; | | pH 10.6 |

EXAMPLE 7 (COMPARISON)

After development and intensification, a layer material according to Example 2 was treated for 15 s with a bleaching/fixing bath of the following composition:

| | |
|---|---|
| Water | 800 ml |
| Ammonium iron (III) EDTA | 45 g |
| Sodium sulfite | 10 g |
| Ammonium thiosulfate | 80 g |

Make up to 1,000 ml and adjust to pH 6.0.

The processed and dried samples were measured behind blue, green, red and infrared filters (850 nm).

IR[1)] is the value measured in Transparency, IR[2)] the value measured in reflection. The values for blue (B), green (G) and red (R) are all measured in reflection.

The measurement results set out in Table 1 show that the IR absorption of a bleached/fixed sample (Example 7) is minimal. It can also be seen that a material (Example 1) which gives adequate color density for an intensification process with no bleaching/fixing in the processing cycle shows increased IR absorption by comparison with Example 7. However, it proved to be inadequate in practice. Examples 2 to 6 according to the invention show that IR absorption can be distinctly improved. Colored identifications with good color quality in the image part (for example portrait) and clear IR readability in the transparent zones (lettering or data part) were obtained with the materials corresponding to Examples 2 to 6.

TABLE 1

| | $D_{max}$ B | G | R | IR[1)] | IR[2)] |
|---|---|---|---|---|---|
| Example 1 | 2.69 | 2.54 | 2.44 | 0.88 | 0.46 |
| Example 2 | 2.41 | 2.40 | 2.66 | 1.46 | 0.95 |
| Example 3 | 2.45 | 2.52 | 2.63 | 1.43 | 0.94 |
| Example 4 | 2.40 | 2.41 | 2.70 | 1.50 | 0.98 |
| Example 5 | 2.52 | 2.56 | 2.81 | 1.59 | 1.04 |
| Example 6 | 2.32 | 2.28 | 2.70 | 1.41 | 0.94 |
| Example 7 | 2.33 | 2.20 | 2.52 | 0.40 | 0.10 |

Examples 1 and 7 are comparisons.

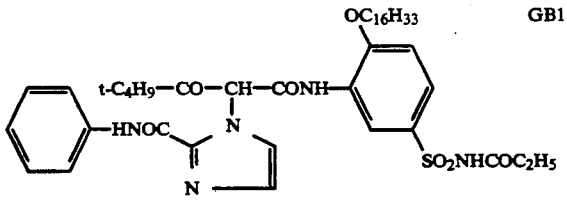

GB1

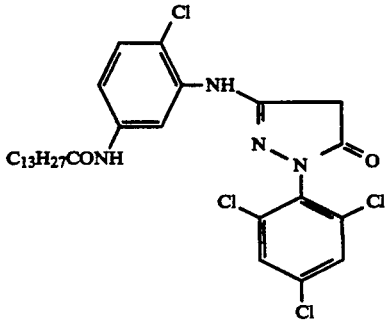

PP1

-continued

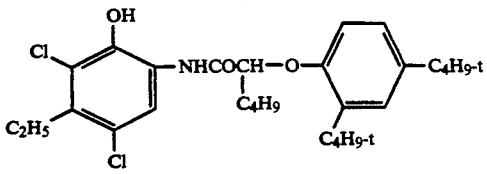

BG1

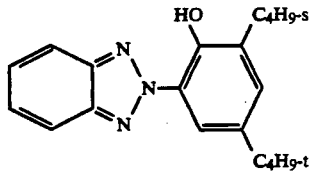

UV-1

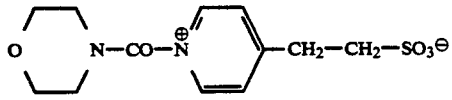

H1

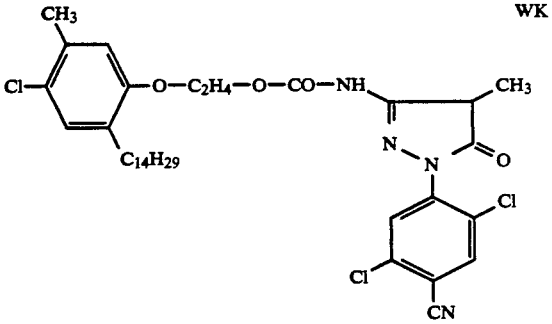

WK 1

We claim:

1. A color photographic recording material comprising at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler and, optionally, a silver halide emulsion layer with no color coupler, of which the silver halide coatings together, expressed as $AgNO_3$, amount to no more than 0.8 g/m$^2$ and of which the silver halides have a silver chloride component of at least 95 mol-%, characterized in that the silver halide coating for one color sensitivity containing at least one color coupler together with the silver halide coating of the silver halide emulsion layer with no color coupler, expressed as $AgNO_3$, is from 0.2 to 0.6 g/m$^2$ and the silver halide coating of all the other silver halide emulsion layers together, expressed as $AgNO_3$, amounts to no more than 0.2 g/m$^2$.

2. A color photographic recording material as claimed in claim 1, characterized in that all the silver halide emulsions are silver chloride bromide emulsions containing 0.1 to 3 mol-% silver bromide or pure AgCl emulsions.

3. A color photographic recording material as claimed in claim 2, characterized in that the silver bromide content is 0.2 to 2 mol-% and the silver halide emulsions are iodide-free.

4. A color photographic recording material as claimed in claim 1 of a reflective support to which a blue-sensitive layer containing at least one yellow coupler, a green-sensitive layer containing at least one magenta coupler, a pan-sensitive layer with no color coupler and a red-sensitive layer containing at least one cyan coupler are applied in the order indicated and also typical interlayers and protective layers are present.

5. A method for processing a color photographic recording material comprising at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler and, a silver halide emulsion layer with no color coupler, in which the silver halide coatings together, expressed as $AgNO_3$, amount to no more than 0.8 $g/m^2$ and in which the silver halides have a silver chloride component of at least 95 mol-% and in which silver halide coating for one color sensitivity containing at least one color coupler together with the silver halide coating of the silver halide emulsion layer with no color coupler, expressed as $AgNO_3$, is from 0.2 to 0.6 $g/m^2$ and the silver halide coating of all the other silver halide emulsion layers together, expressed as $AgNO_3$, amounts to no more than 0.2 $g/m^2$ by the steps comprising (a) development, (b) intensification, (c) fixing or stabilization, (d) optionally rinsing and (e) drying; wherein development is carried out with a color developer of the p-phenylenediamine series; intensification is carried out with $H_2O_2$; development and intensification may be combined into a single step and no bleaching is carried out.

* * * * *